US009024856B2

(12) United States Patent
Woo et al.

(10) Patent No.: US 9,024,856 B2
(45) **Date of Patent: *May 5, 2015**

(54) SIGNAL DRIVING CIRCUIT OF LIQUID CRYSTAL DISPLAY DEVICE AND DRIVING METHOD THEREOF

(71) Applicant: LG Display Co., Ltd., Seoul (KR)

(72) Inventors: You Tack Woo, Daegu-si (KR); Kyeong Kun Jang, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 14/075,203

(22) Filed: Nov. 8, 2013

(65) Prior Publication Data

US 2014/0098012 A1 Apr. 10, 2014

Related U.S. Application Data

(63) Continuation of application No. 10/650,992, filed on Aug. 29, 2003, now Pat. No. 8,581,820.

(30) Foreign Application Priority Data

Sep. 6, 2002 (KR) ..... 10-2002-53763

(51) Int. Cl.
*G09G 3/36* (2006.01)

(52) U.S. Cl.
CPC ..... *G09G 3/3685* (2013.01); *G09G 3/3614* (2013.01); *G09G 3/3688* (2013.01); *G09G 2310/027* (2013.01); *G09G 2320/0247* (2013.01); *G09G 2320/0276* (2013.01); *G09G 2320/0606* (2013.01); *G09G 2320/0626* (2013.01); *G09G 2320/0673* (2013.01)

(58) Field of Classification Search
None
See application file for complete search history.

(56) References Cited

U.S. PATENT DOCUMENTS

| | | | | |
|---|---|---|---|---|
| 5,402,142 | A * | 3/1995 | Okada et al. | 345/95 |
| 5,754,150 | A | 5/1998 | Matsui | |
| 6,229,510 | B1 | 5/2001 | Kim et al. | |
| 6,310,616 | B1 | 10/2001 | Yanagi et al. | |
| 6,373,478 | B1 | 4/2002 | Steffensmeier | |
| 6,570,551 | B2 | 5/2003 | Inoue et al. | |
| 6,593,934 | B1 | 7/2003 | Yang et al. | |
| 6,624,800 | B2 | 9/2003 | Hughes et al. | |
| 6,879,310 | B2 | 4/2005 | Nose | |
| 6,987,499 | B2 | 1/2006 | Yamaguchi et al. | |
| 2002/0063666 | A1 * | 5/2002 | Kang et al. | 345/87 |
| 2002/0126112 | A1 | 9/2002 | Kato | |
| 2003/0122757 | A1 | 7/2003 | Bu | |
| 2004/0169629 | A1 | 9/2004 | Lee et al. | |

FOREIGN PATENT DOCUMENTS

| | | | |
|---|---|---|---|
| JP | 05165007 | A | 6/1993 |
| JP | 06175622 | A | 6/1994 |
| WO | 02103437 | A2 | 12/2002 |

* cited by examiner

*Primary Examiner* — Seokyun Moon
(74) *Attorney, Agent, or Firm* — Morgan, Lewis & Bockius LLP

(57) ABSTRACT

A signal driving circuit of a liquid crystal display device includes a column driver for converting video data input into analog signals and applying said analog signals to pixels of a liquid crystal panel, a gamma voltage circuit for applying a plurality of signal voltages to the column driver and an external voltage supplying unit for generating and adjusting signal voltages and a common voltage applied to the gamma voltage circuit and the common electrode, respectively.

8 Claims, 7 Drawing Sheets

SIGNAL DRIVING CIRCUIT OF LIQUID CRYSTAL DISPLAY DEVICE AND DRIVING METHOD THEREOF

This application is a continuation of U.S. patent application Ser. No. 10/650,992, filed on Aug. 29, 2003, which claims the benefit of Korean Patent Application No. 10-2002-53763, filed in Korea on Sep. 6, 2002, the entire disclosure of each of which is hereby incorporated by reference herein for all purposes.

BACKGROUND OF THE INVENTION

1. Field of the Invention

The present invention relates to a liquid crystal display device, and more particularly, to a signal driving circuit of a liquid crystal display device and a driving method thereof being arranged.

2. Discussion of the Related Art

A liquid crystal display (LCD) device is widely used to display various images including still images and moving images. The picture quality of an LCD device has greatly improved due to the development of technology for processing fine pixels and to the use of new liquid crystal materials. An LCD device has the characteristics light weight, a slim profile and low power consumption. An LCD device has a wide range of applications that are still broadening. An LCD device is typically composed of a liquid crystal panel, which includes a pair of substrates, one of them being at least made of a transparent glass, and a liquid crystal layer interposed between the two substrates. An LCD device can be classified into two types of devices, a passive matrix-typed LCD device and an active matrix-typed LCD device depending on the structure and driving method of the LCD device.

The passive matrix-typed LCD device has the advantages of easy fabrication and simple driving method, but has the disadvantages of high power consumption with little driving capability and a large number of scan lines. The active matrix-typed LCD device has the advantages of allowing the fabrication of a high quality device since it is structured to have a thin film transistor (TFT) in every pixel within the pixel region such that each pixel can be independently driven. By using a thin film transistor in each pixel, an active matrix-typed LCD device effectively displays moving images.

FIG. 1 is a block diagram of a related art active matrix-typed LCD device. As shown in FIG. 1, the related art active matrix-typed LCD device includes a column driver 3 for supplying the image data, which is input from an external video card 1, to a liquid crystal panel 6. The active matrix-typed LCD device also includes a gamma voltage circuit 4 for supplying signal voltages to the column driver 3, a row driver 5 for supplying scanning signals for controlling the switching operation of the thin film transistors in the liquid crystal panel 6, and a controller 2 for controlling the column driver 3 and the row driver 5. Normally, the liquid crystal panel 6 is of an XGA level (1024×768 pixels) of resolution that includes 1024×3 (RGB) of source lines. Therefore, in an LCD device having a XGA level of resolution, eight column drivers 3 (384×8=3072) are employed, each having an output terminal of 384 channels and four row drivers 5, each having an output terminal of 200 channels.

The analog video data supplied from the digital video card 1, installed in the body of a computer, is supplied to the column driver 3 through the operation of the controller 2. In the alternative, the analog image signal input from a computer is converted into digital video data through an interface module installed in a liquid crystal monitor, and then, is input into an LCD device. The row driver 5 applies one scanning pulse every frame to each scanning line, and the timing of the pulse is normally sequentially applied from the top of the liquid crystal panel 6 to the bottom of the liquid crystal panel 6. The column driver 3 applies liquid crystal driving voltages corresponding to the pixels in one line, while a scanning pulse is applied to the pixels. In other words, the column driver 3 is for applying signal voltages to each signal line.

The thin film transistor connected to the scanning line in the selected pixel is turned "on" when a scanning pulse is applied to the gate electrode of the thin film transistor. Then, the liquid crystal driving voltage passes from the signal line through the drain and the source of the thin film transistor, and is applied to the pixel electrode so as to charge a pixel capacitor. By repeating this operation for each pixel, the image data voltages corresponding to the image signal for each of the pixels for the entire panel are applied in a frame. Further, if the image data voltages are applied to the pixels in only one direction when driving the pixel array, it is necessary to periodically invert the image data voltages applied to the panel to prevent the overheating of the liquid crystal in the pixels due to one-directionally flow of voltage across a substantial portion of the liquid crystal layer for an extended length of time.

The period for changing the direction of the signal voltage, that is, a normal direction to an inverse direction or vice versa, is one field. There are several kinds of methods, such as a field inversion method of changing the voltage polarity of all the pixels in the panel in a field, a line inversion method of alternately changing the voltage polarity of the pixels in a line connected to a scanning line, and a dot inversion method of alternately changing the voltage polarity of each pixel. In all of these cases, the voltage direction should be alternately inverted such that the direction of the pixel voltage (the voltage applied to the pixel electrode from the drain of the thin film transistor) is a normal (+) direction or an inverse (−) direction with respect to the common voltage (Vcom).

FIG. 2 is a detailed block diagram of the column driver depicted in FIG. 1. As shown in FIG. 2, a data latch 41 latches video data 10, 11, 12 input into a pixel. In the case of the LCD device receiving odd number and even number video data, the data latch 41 latches the input video data in the unit of two pixels. A shift register 40 sequentially generates latch enable signals for storing the video data into the line latch in synchronization with external clock signals. The line latch 42 sequentially stores the input video data in synchronization with the latch enable signal. The line latch 42 includes first and second registers (not shown), each having one line size (the number of the source lines connected to one column driver is 384×6 bits in this example). If the video data of one line is stored in the first register, the line latch 42 moves the video data of one line stored in the first register to the second register at the same time. Then, the line latch 42 sequentially stores the video data of another line into the first register.

A digital to analog converter 43 of FIG. 2 receives a plurality of signal voltages from a gamma voltage circuit 4. Then, the digital to analog converter 43 selects at least one or two signal voltages of the plurality of signal voltages input corresponding to each video data from the second register of the line latch. Then, the digital to analog converter 43 divides the selected signal voltage corresponding to the video data, and outputs through each source line of an output buffer 44 as analog image signals. Although not depicted in FIG. 2, a constant common voltage is input into a common electrode in addition to the pixel voltages input to the pixel electrodes through the source lines. The voltage difference between the pixel voltage and the common voltage across the liquid crystal layer determines a gray level of the displayed image of the pixel.

FIG. 3 is a representation of the structure of a digital to analog converter inside the conventional gamma voltage circuit and the column driver. The gamma voltage circuit and the digital to analog converter of FIG. 3 are the same as those in FIG. 2, and like numerals will be used to refer to like elements. As shown in FIG. 3, the digital to analog converter 43 includes a resistance network for distributing the signal voltages 18, which are selected to correspond to the video data 45, into interior gray-scale voltages. The signal voltages 18 can be adjusted from the outside. The gray-scale voltages 47 between each tap point are automatically determined by the resistance network inside the digital to analog converter.

The digital video data 45 input into the column driver (not shown) is input into the digital to analog converter 43 through the data latch and the line latch. A plurality of signal voltages 18 output from the gamma voltage circuit 4 are input into the digital to analog converter 43. The plurality of signal voltages 18 are distributed into a plurality of gray-scale voltages 47 by the resistance network inside the digital to analog converter 43. Each value of the digital video data 45 input as above and the signal voltages 18 supplied by the gamma voltage circuit 4 are distributed into the gray-scale voltages 47 by the resistance network. The distributed gray-scale voltages 47 are output through each signal line, that is, source line as analog image signal through an output buffer 49 corresponding to the video data 45.

The signal voltages 18 output from the gamma voltage circuit 4 are input as positive (+) voltage and negative (−) voltage with respect to the common voltage (Vcom) 50, and are again distributed into a plurality of gray-scale voltages 47 by the resistance network inside the digital to analog converter 43. The gray-scale voltages 47 can be realized differently according to the signal voltages 18 distributed by the external fixed resistance, but are fixed in hardware so that a user cannot change.

The column driver selects one gray-scale voltage 47 of the plurality of gray-scale voltages 47 distributed from the fixed signal voltages 18 supplied by the gamma voltage circuit 4, and corresponding to the input digital video data 45, and then, applies the selected gray-scale voltage to each signal line connected to pixels for liquid crystal cells. The common voltage 50 supplied to the common electrode is individually fixed and applied independently from the gamma voltage circuit 4. However, there is a need to adjust the gray-scale voltage 47 externally of the signal driving circuit such that a user can vary the gradation or the brightness of an LCD device, and nowadays, this need is commercially realized in LCD devices.

FIG. 4 is a graphical representation of the output of gray-scale voltages with respect to a common voltage. As shown in FIG. 4, one gray-scale voltage is arbitrarily selected, and its level of the voltage is illustrated. When a pixel is selected by the row driver, the specific pixel is charged with the one of the gray-scale voltages. When the pixel is selected at the initial time of one horizontal period, the gray-scale voltage is a positive (+) voltage 51 above a common voltage. A negative (−) gray-scale voltage 52 is applied to the selected pixel during the next horizontal period such that its absolute value corresponds to the absolute value of the positive (+) voltage applied to the selected pixel during the previous horizontal period. Therefore, the voltage, which is applied to each pixel, is changed into the gray-scale voltage and alternately changed between the levels of a normal (+) voltage and an inverse (−) voltage. Thus, an alternating current is applied to each pixel. Further, the common voltage (Vcom) 50 can be a direct voltage or an alternating voltage, and the level of each gray-scale voltage is determined with respect to the common voltage 50.

When the absolute values of the normal (+) gray-scale voltage 51 and the inverse (−) gray-scale voltage 52 are different, that is, each level of the gray-scale voltages is not equal to each other with respect to the center of the common voltage 50, the LCD device can be damaged or heated. Further, the characteristics of the pixels can be changed so as to cause a flickering phenomenon or image sticking phenomenon to occur. Therefore, the gray-scale voltages should be maintained symmetric with respect to the center of the common voltage, which is difficult in actual applications. For example, a user needs to adjust the gray-scale by an external control of the common voltage in order to vary the gray-scale or the brightness of an LCD device. However, changing the common voltage causes the absolute values of the normal (+) gray-scale voltage 51 and the inverse (−) gray-scale voltage 52 to be different such that the gray-scale voltages are not symmetrical with respect to the center of the common voltage 50, which causes the problems of image flickering or image sticking.

SUMMARY OF THE INVENTION

Accordingly, the present invention is directed to a signal driving circuit of a liquid crystal display device, and a driving method thereof that substantially obviate one or more problems due to limitations and disadvantages of the related art.

An object of the present invention is to provide a signal driving circuit of a liquid crystal display device, and a driving method thereof, in which gray-scale voltages are adjusted by an external system in varying the gray-scale and the brightness of an LCD device.

Another object is to symmetrically maintain the levels of positive (+) and negative (−) gray-scale voltages with respect to the common voltage such that the image quality of the LCD device is improved.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a signal driving circuit of a liquid crystal display device includes a column driver for converting video data input into analog signals and applying said analog signals to pixels of a liquid crystal panel, a gamma voltage circuit for applying a plurality of signal voltages to the column driver and an external voltage supplying unit for generating and adjusting signal voltages and a common voltage applied to the gamma voltage circuit and the common electrode, respectively.

In another aspect, a signal driving circuit of a liquid crystal display device includes an external system for adjusting gray-scale voltages of the liquid crystal display device, wherein a common voltage is adjusted by the external system such that the absolute values of a normal (+) gray-scale voltage and an inverse (−) gray-scale voltage are the same with respect to the center voltage of the common voltage and to compensate for the absolute values of the gray-scale voltages levels that are different due to a variation of the gray-scale voltages.

In another aspect, a method of driving signals of a liquid crystal display device in which gray-scale voltages of the liquid crystal display device are adjusted by an external system, the method includes the steps of selecting digital data such that the absolute values of a normal (+) gray-scale voltage and an inverse (−) gray-scale voltage are the same with respect to the center voltage of a common voltage to compensate for changes in absolute values of the gray-scale voltages levels due to variations in the gray-scale voltages and converting the selected digital data into an analog voltage that is input into a common electrode.

It is to be understood that both the foregoing general description and the following detailed description of the present invention are exemplary and explanatory, and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 5:
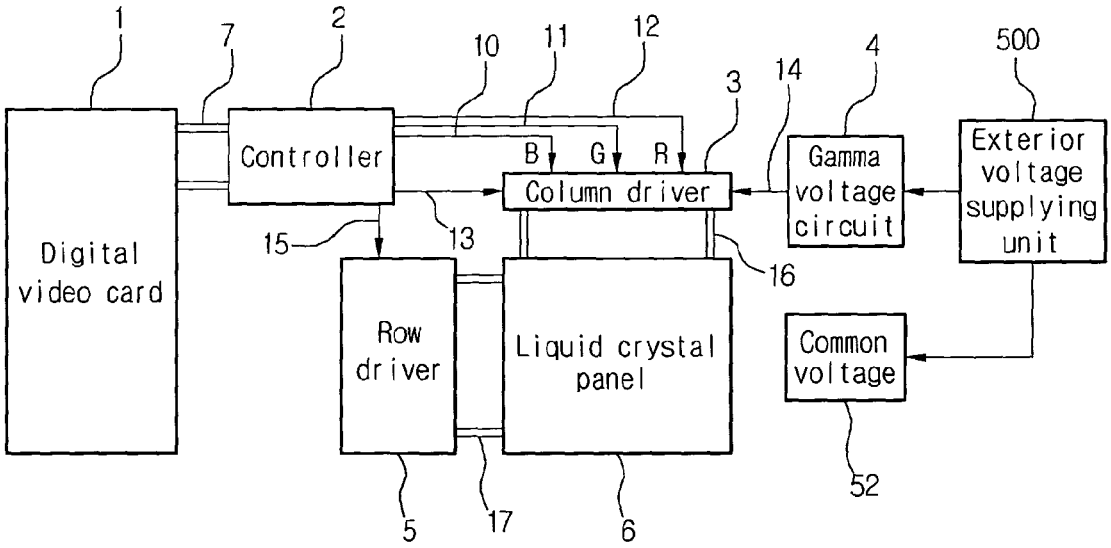
FIG. 5 is a block diagram of an active matrix-typed LCD device of an embodiment of the present invention.

FIG. 5 is a block diagram of an active matrix-typed LCD device of an embodiment of the present invention. Like numerals will be used to refer to like elements in the related art active matrix-typed LCD device. As shown in FIG. 5, the structure of the active matrix-type LCD device of an embodiment of the present invention includes an external voltage supplying unit 500 for supplying signal voltages input to a gamma voltage circuit 4. The external voltage supplying unit 500 supplies a plurality of signal voltages to the gamma voltage circuit 4, and also supplies a common voltage to a common electrode 52. Further, the external voltage supplying unit 500 provides a function to adjust the signal voltages and the common voltage thereinside prior to supplying the voltages to respective units so as to vary the gray-scale and the brightness of the LCD device. As a result, the external voltage supplying unit 500 provides the advantages of minimizing the occurrence of the flickering and the image sticking.

Figure 3:
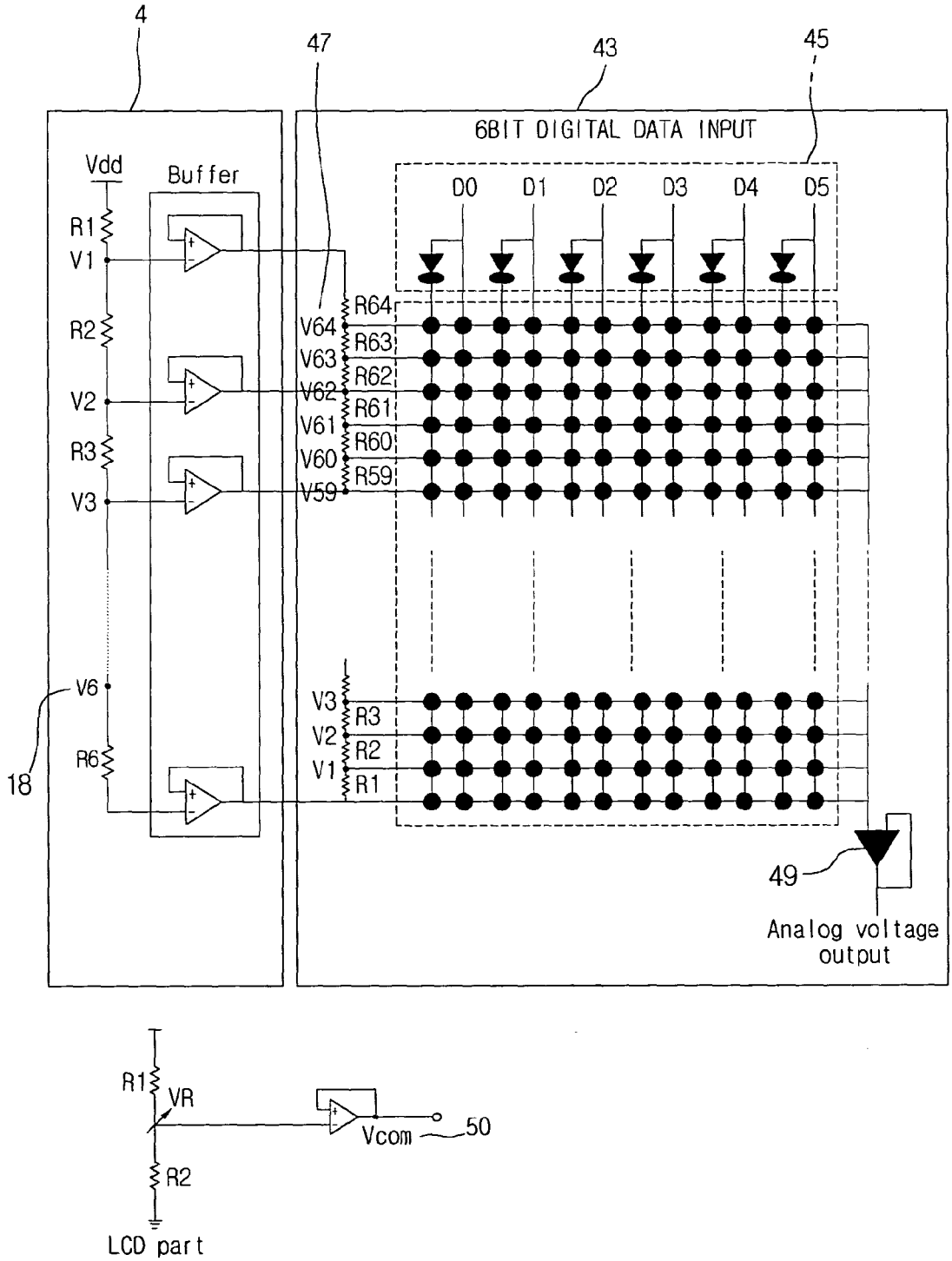
Fig.3 Related Art
FIG. 3 is a representation of the structure of a digital to analog converter inside a conventional gamma voltage circuit and the column driver.
Figure 4:
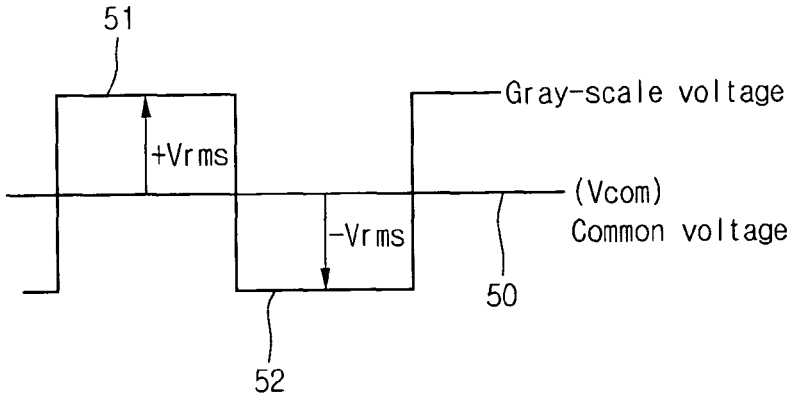
Fig.4 Related Art
FIG. 4 is a graphical representation of the output of gray-scale voltages with respect to a common voltage.
Figure 6:
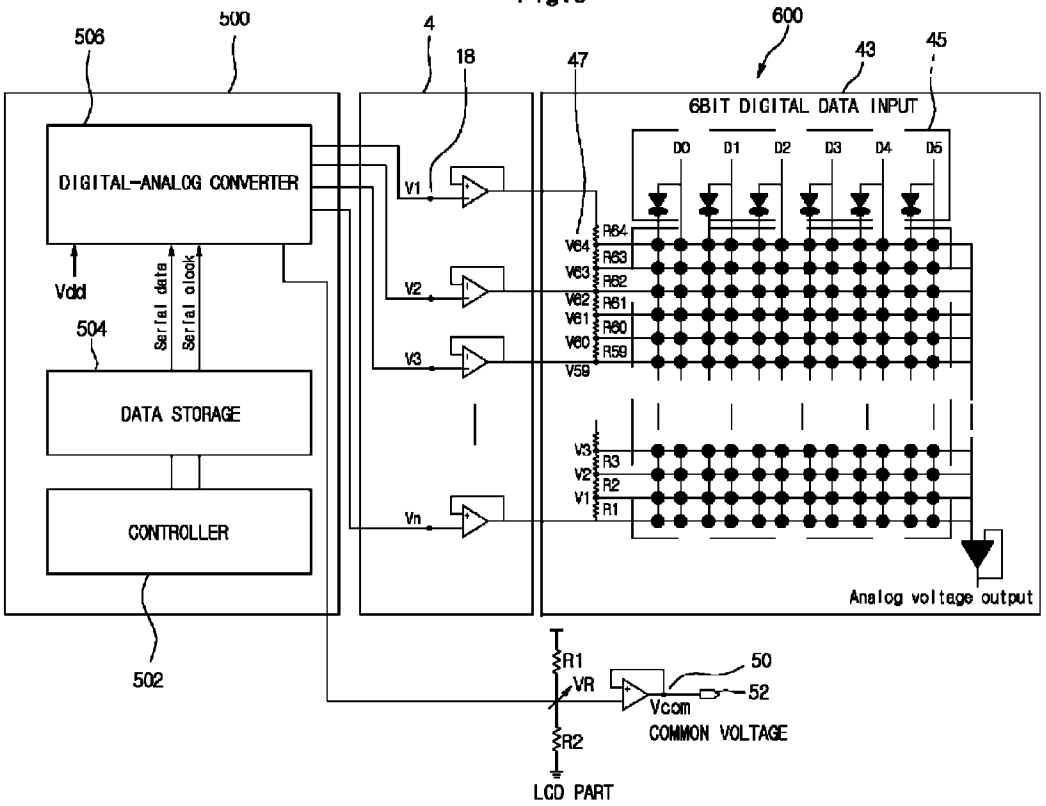
FIG. 6 is a representation of the structure of a signal driving circuit of the active matrix-typed LCD device in accordance with an embodiment of the present invention.

FIG. 6 is a representation of the structure of a signal driving circuit of the active matrix-typed LCD device in accordance with an embodiment of the present invention. FIG. 6 illustrates a gamma voltage circuit 4 and digital to analog converter 43 having like numbers to like elements that were described with regard to FIG. 3. A signal driving circuit 600 of the LCD device includes a column driver (not shown) for converting a video data 45 input from the outside into analog signals and supplying to pixel electrodes of a liquid crystal panel. The gamma voltage circuit 4 of the driving circuit 600 supplies a plurality of signal voltages 18 to the column driver, which convert the video data 45 into analog signals. The external voltage supplying unit 500 generates signal voltages 18 and a common voltage 50. More particularly, the external voltage supplying unit 500 adjusts the signal voltages 18 and a common voltage 50 before being applied to the gamma voltage circuit 4 and the common electrode 52 respectively.

Figure 1:
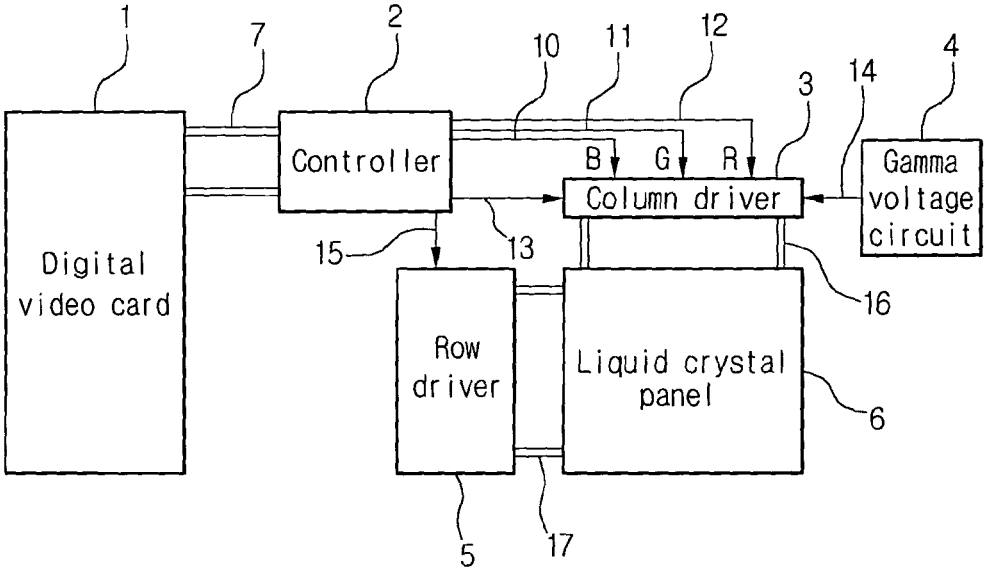
Fig. 1 Related Art
FIG. 1 is a block diagram of a related art active matrix-typed LCD device.
Figure 2:
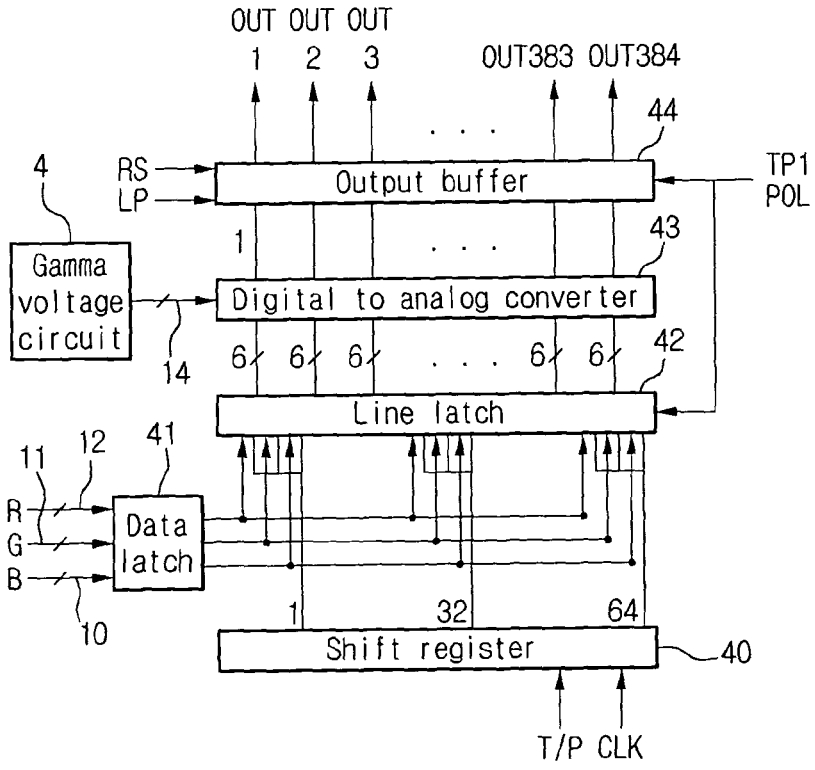
Fig.2 Related Art
FIG. 2 is a detailed block diagram of a column driver depicted in FIG. 1.

In FIG. 6, only inside the column driver is illustrated. The structure and operation of the column driver for embodiments of the present invention is the same as discussed with regard to the related art column driver in FIG. 2. Further, the video data 45 input into the column driver is composed of n bits, and the video data 45 input into the digital to analog converter 43 inside the column driver is also composed of n bits. For the convenience of description herein, FIG. 6 illustrates an example of only six (6) bits.

The signal voltages 18 input into the column driver through the gamma voltage circuit 4 are distributed into a plurality of gray-scale voltages 47 by a resistance network inside the column driver. The video data 45 input into the column driver selects one of the distributed gray-scale voltages 47, and outputs the selected gray-scale voltage 47 to a source line to supply a pixel within the liquid crystal cell. The distributed number of gray-scale voltages 47 is determined according to the number of bits in the input video data 45. As shown in FIG. 6, if G-bit video data 45 is input, the gray-scale voltages 47 are distributed into sixty four (64) levels. In another example if 8-bit video data 45 is input, the gray-scale voltages 47 are distributed into two hundred fifty six (256) levels.

In the related art signal driving circuit, the number and levels of gray-scale voltages are generated from the signal voltages input from the outside, which are determined according to a resistance network inside the column driver. Since the resistance network inside the column driver has a fixed value, the values of the gray-scale voltages are also fixed and cannot be changed arbitrarily by a user. Therefore, according to this embodiment of the present invention, the signal driving circuit further includes an external voltage supplying unit 500 to vary the gray-scale and the brightness of the LCD device so that the signal voltages 18 can be adjusted via an external control and the gray-scale voltages 47 can be varied. Also, the common voltage (Vcom) 52 can be adjusted in order to prevent flickering and image sticking due to the variance of the gray-scale voltages 47.

The external voltage supplying unit 500 includes a data storing part 504 for storing a plurality of signal voltage data, a controlling part 502 for selecting and outputting a signal voltage data stored in the data storing part 504, and a digital to analog converting part 506 for converting the signal voltage data output from the data storing part 504 into analog voltages that are output to the gamma voltage circuit 4 or the common electrode 52. The data storing part 504 stores a plurality of signal voltage data, which can be the experimentally-determined digital data by applying compatible apparatus, and many different and discrete data can be stored therein. The data storing part 504, having a plurality of signal voltage data stored therein, is controlled by the controlling part 502, and the controlling part 502 is an element for performing a command as selected by a user. Thus, if a user wishes to change the characteristics of the signal voltages 18 (that is, to vary the gray-scale voltages 47), the controlling part 502 commands to display the signal voltage data stored in the data storing part 504 on a screen, to select and to send some signal voltage data among the above data to the digital to analog converting part 506. Through the above process, a user can control the gray-scale voltages 47 and the common voltage 52 by a simple operation using input controls to the system.

The data storing part 504 sends the data to the digital to analog converting part 506 as serial data, and the digital to analog converting part 506 converts the data into n analog voltages, that is, n signal voltages 18, and outputs them to the gamma voltage circuit through a buffer. In addition, the digital to analog converting part 506 can converts the data into an analog voltage and output to the common electrode through the buffer. The converted analog voltage output to the common electrode 52 is a common voltage 50. The converted analog voltages output to the gamma voltage circuit 4 are a conversion from some selected signal voltage data into a plurality of analog voltages.

The signal voltages 18 are input into the gamma voltage circuit 4 through the digital to analog converting part 506 to vary the gray-scale or the brightness of the LCD device as described above, and the analog voltages input into the common electrode 52 through the digital to analog converting part 506 prevent the flickering or image sticking generated by the variation of the gray-scale voltages 47. The signal voltage data, which is selected to vary the common voltage 52, needs to be selected such that the absolute value of the positive (+) and negative (−) gray-scale voltages 47 is the same in order to compensate the variation of the gray-scale voltages 47 and/or the difference of the absolute value of the positive (+) and negative (−) gray-scale voltages 47. Further, the selection of some digital data, that is, signal voltage data is made every time when the absolute values of positive (+) and negative (−) gray-scale voltages with respect to the common voltage are not the same after the adjustment of the gray-scale voltage, and accordingly, the common voltage is also adjusted.

Figure 7:
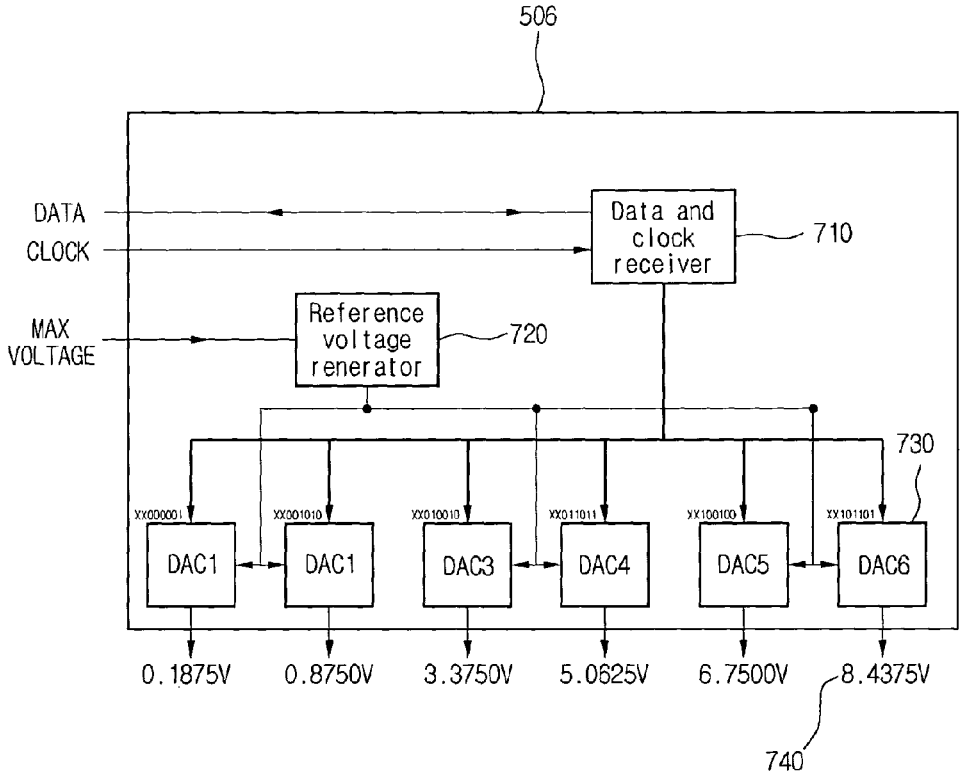
FIG. 7 is a block diagram of a digital to analog converting part of an external voltage supplying unit of an embodiment of the present invention.

FIG. 7 is a block diagram of a digital to analog converting part of an external voltage supplying unit of an embodiment of the present invention. As shown in FIG. 7, the digital to analog converting part 506 includes a data and clock receiver 710, a reference voltage generator 720, and a digital to analog converter (DAC) 730. The digital to analog converter (DAC) 730 in FIG. 7 has six (6) channels, but it is just one exemplary embodiment. The number of the channels is not limited to six.

The operation of the digital to analog converting part 506 will now be described in reference to FIG. 7. If the data from the data storing part (not shown) is supplied to the digital to analog converting part 506, the data is received by the data and the clock receiver 710. Then, the digital to analog converter 730 having subaddress outputs a plurality of DC voltages 740 corresponding to subaddress data from the transmitted data by using the voltage of the reference voltage generator 720. As described above, the selected digital data is converted and output as the plurality of the analog DC voltages 740, and input into the gamma voltage circuit so that adjusted gray-scale voltages, which are different from the previous gray-scale voltages, can be supplied.

To adjust the common voltage, the digital to analog converting part 506 can also be used as it is, but only one digital to analog converter 730 is used in this case. The signal voltage data, being selected to adjust the common voltage, needs to be selected such that the absolute values of the positive (+) and negative (−) gray-scale voltages are the same to avoid that the absolute values of the gray-scale voltages are different due to the variation of the gray-scale voltages 47. Thus, the data is converted into analog voltages through one digital to analog converter inside the digital to analog converting part 506, and applied into the common electrode as common voltage. Therefore, the absolute values of the adjusted positive (+) and negative (−) gray-scale voltages become equal with respect to the converted analog voltage so that the flickering and image sticking phenomenon are removed. Further, the analog voltage generated by the digital to analog converter is not limited to DC voltage, and it could be alternately-changed one between two values of positive (+) and negative (−) voltages according to the characteristics of an LCD device being used.

As described above, in the signal driving circuit in embodiments of the present invention, the common voltage can be adjusted by an external system to compensate for the changes in the absolute values of the positive (+) and negative (−) gray-scale voltages with respect to the common voltage due to the variance of the gray-scale voltages, and the external system corresponds to the external voltage supplying unit as described above. As described above, according to the signal driving circuit of the LCD device and the driving method thereof of the present invention, the gray-scale voltages are adjusted by an external system in varying the gray-scale and the brightness of an LCD device, and the common voltage can be also adjusted by the external system so as to minimize the occurrence of the flickering phenomenon and the image sticking phenomenon of the images in the LCD device. Further, a user can externally adjust the gray-scale voltages and the common voltage precisely by a simple operation.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A signal driving circuit of a liquid crystal display device, the signal driving circuit comprising:

a column driver configured to convert a video data into analog gray-scale voltages corresponding to a plurality of analog signal voltages and apply the analog gray-scale voltages to pixels of a liquid crystal panel; and an external voltage supplying unit comprising a digital to analog converting part that is coupled to a common electrode of the liquid crystal panel, wherein the digital to analog converting part is configured to:

generate the plurality of analog signal voltages, and supply one of the plurality of analog signal voltages to the common electrode of the liquid crystal panel as a common voltage, and wherein, when the plurality of analog signal voltages are adjusted to vary a brightness of the liquid crystal panel, the plurality of adjusted analog signal voltages including a normal (+) adjusted gray-scale voltage and an inverse (−) adjusted gray-scale voltage, the common voltage supplied to the common electrode from the digital to analog converting part being adjusted such that the absolute values of the normal (+) adjusted gray-scale voltage and the inverse (−) adjusted gray-scale voltage have a same voltage difference with respect to the adjusted common voltage, the adjusted common voltage being supplied to the common electrode of the liquid crystal panel.

2. The signal driving circuit according to claim 1, wherein the external voltage supplying unit further comprises:

a data storing part configured to store a plurality of digital signal data; and a controlling part configured to select a signal data that represents a modification of one of a gray-scale voltage in the data storing part and apply the selected digital signal data to the digital to analog converting part.

3. The signal driving circuit according to claim 2, wherein the plurality of signal data are data for varying a brightness of the liquid crystal panel.

4. The signal driving circuit according to claim 2, wherein the signal data supplied to the external voltage supplying unit are converted into the plurality of analog signal voltages.

5. The signal driving circuit according to claim 1, wherein the column driver distributes the plurality of analog signal voltages into the analog gray-scale voltages.

6. The signal driving circuit according to claim 1, wherein the digital to analog converting part comprises:

a reference voltage generator configured to generate a reference voltage, and a plurality of digital to analog converters coupled to the reference voltage generator.

7. The signal driving circuit according to claim 6, wherein, if the signal data represents the modification of the gray-scale voltage, the plurality of digital to analog converters generate a plurality of modified signal voltages.

8. The signal driving circuit according to claim 6, wherein, if the signal data represents the modification of the common voltage:

one of the plurality of digital to analog converters generates a modified common voltage; and the absolute values of a normal (+) gray-scale voltage and an inverse (−) gray-scale voltage have the same voltage difference with respect to the modified common voltage.

* * * * *